United States Patent [19]

Truman

[11] Patent Number: 4,523,336

[45] Date of Patent: Jun. 18, 1985

[54] METHOD FOR MANUFACTURE OF SLEEVED GARMENTS OUTSIDE OUT

[75] Inventor: Charles L. Truman, Hendersonville, N.C.

[73] Assignee: Kimberly-Clark Corporation, Neenah, Wis.

[21] Appl. No.: 415,659

[22] Filed: Sep. 7, 1982

[51] Int. Cl.[3] ..... A41D 13/00

[52] U.S. Cl. ..... 2/69; 2/114; 2/115; 2/79; 2/243 R

[58] Field of Search ..... 2/263 R, 243 B, 69, 2/79, 227, 114, 47 R, 115

[56] References Cited

U.S. PATENT DOCUMENTS

| | | | |
|---|---|---|---|
| Re. 30,520 | 2/1981 | Pierron | 2/243 R X |
| 2,993,528 | 7/1961 | Plant, Jr. | 154/42 |
| 3,129,432 | 4/1964 | Belkin | 2/114 |
| 3,139,365 | 6/1964 | Andrews | 156/179 |
| 3,146,465 | 9/1964 | Hummel | 2/49 |
| 3,221,341 | 12/1965 | Hummel | 2/49 |
| 3,435,461 | 4/1969 | Artzt | 2/83 |
| 3,574,238 | 4/1971 | McCurry | 2/243 R |
| 3,585,641 | 6/1971 | Pierron | 2/79 |
| 3,681,785 | 8/1972 | Truman | 2/243 R |
| 3,696,445 | 10/1972 | Craig | 2/243 R |
| 3,769,635 | 11/1973 | Pierron | 2/243 R |
| 3,798,678 | 3/1974 | Pierron et al. | 2/243 R |
| 3,858,243 | 1/1975 | Pierron et al. | 2/243 R |
| 4,316,756 | 2/1982 | Wilson | 2/243 B X |

*Primary Examiner*—H. Hampton Hunter

*Attorney, Agent, or Firm*—William D. Herrick; R. Jonathan Peters

[57] ABSTRACT

A method for the continuous manufacture of sleeved garments from webs and pre-manufactured sleeves, which garments are manufactured in an outside out condition. The method entails assembling continuous webs and pre-manufactured sleeves and joining such components by forming seams such that the sleeves are on the outside of the finished garment and the garment is provided with finished seams.

5 Claims, 21 Drawing Figures

32b SLEEVE
34 FRONT
32b SLEEVE
34 FRONT
34 FRONT
35 BACK
32d SLEEVE
70 FRONT WEB

METHOD FOR MANUFACTURE OF SLEEVED GARMENTS OUTSIDE OUT

TECHNICAL FIELD

This invention relates to the manufacture of garments and, more particularly, to the manufacture of garments from continuous webs which form the backs and fronts of the garments and pre-manufactured sleeves, which are combined with the continuous webs to provide finished garments in series and adapted to be severed into individual garments.

BACKGROUND ART

Heretofore garments have been made in series from webs and pre-manufactured sleeves using automated production lines, a particularly significant process and apparatus for such manufacture being illustrated in my prior U.S. Pat. No. 3,681,785. Using this process and apparatus, or the process and apparatus of other prior patents, such as Pierron, U.S. Pat. No. Re. 30,520, and Craig, U.S. Pat. No. 3,696,445, the garment, as manufactured and packaged for delivery to the user, is in an inside out condition where the sleeves are on the inside of the folded garment. With the garment inside out, the garment must be reversed to be put on. There are certain advantages to delivering garments to users inside out. For example, in the case of hospital gowns, which are sterilized, it is an advantage to have such gowns inside out since they may more readily be donned with assistance in such a way as to maintain the outside sterile, since only the inside surface of the garment needs to be touched as the garment is put on.

In other cases it may be preferred to package the garment outside out so that the user will find the garment in a condition to be put on without having to reverse the garment; the proper procedure for unfolding such an inside out garment may not be readily apparent, particularly the first time a user removes the garment from a package and dons such a garment.

DISCLOSURE OF INVENTION

Accordingly, the principal object of this invention is to provide a method for the continuous manufacture of sleeved garments from webs and pre-manufactured sleeves, which garments are manufactured in an outside out condition.

A further object of this invention is to provide for folding such garments in an outside out condition for packaging without requiring or providng unfolding operations on line to reverse the garment to reach the outside out condition.

A related object is to provide a method for the manufacture of sleeved garments which entails assembling continuous webs and pre-manufactured sleeves and joining such components by forming seams such that the sleeves are on the outside of the garment and the garment is provided with side seams that have a finished appearance.

Thus, it is an object to provide a sleeved garment particularly suited to be manufactured from continuous webs and pre-manufactured sleeves in a continuous series with the use of automated production line equipment and which is capable of being manufactured in an outside out condition ready for folding and packaging to distribute to users.

BRIEF DESCRIPTION OF DRAWINGS

Further objects will become evident from the following description taken in conjunction with the accompanying drawings, in which.

BEST MODE FOR CARRYING OUT THE INVENTION

Turning to the drawings, there is shown in FIGS. 1–4 a garment 30 with sleeves 32*a* and 32*b* manufactured in accordance with this invention using a method and apparatus embodying the invention and schematically illustrated in FIGS. 9–15. To facilitate description of the method and product of this invention, the drawings also illustrate a prior art garment 40 in FIGS. 5–7 and an automated production line to manufacture such prior art garment in FIGS. 16–21, which automated line is of the type described and shown in aforementioned U.S. Pat. No. 3,681,785.

Figure 4:
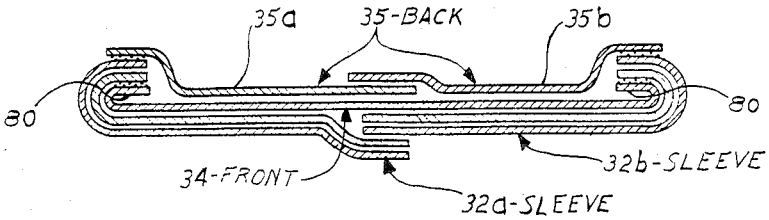
FIG. 4 is a transverse sectional view taken in the plane of lines 4—4 in FIG. 9 of the garment shown in FIG. 1 in the process of being manufactured, with the sleeves folded adjacent the front section of the garment rather than extended as in FIG. 1.
Figure 5:
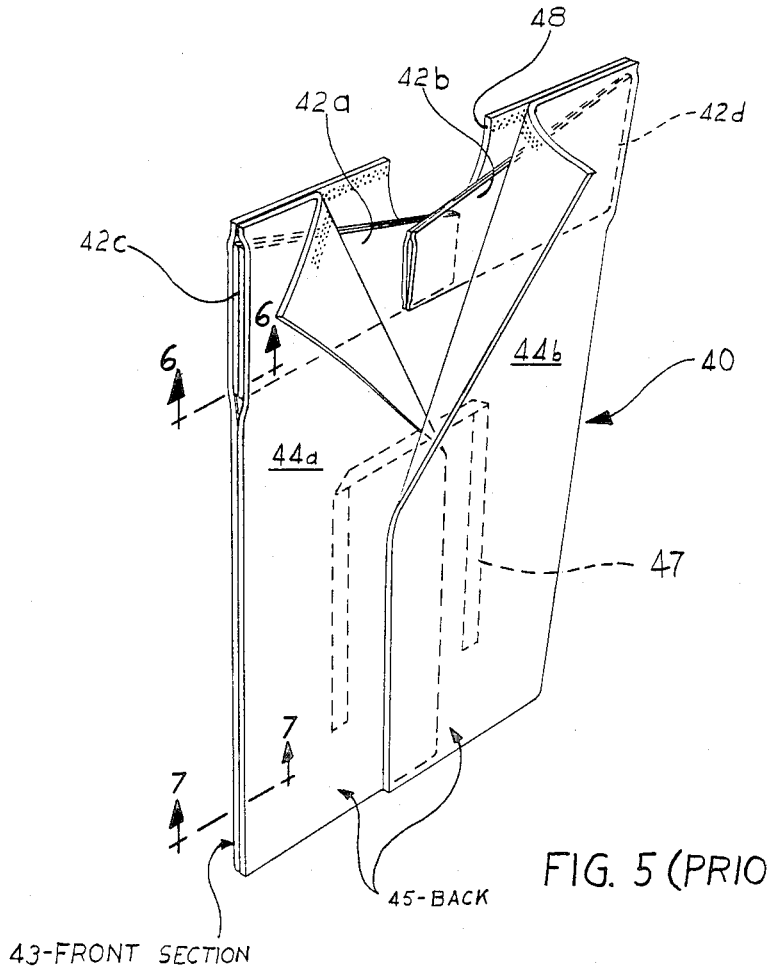
FIG. 5 (PRIOR ART)
FIG. 5 is a perspective view similar to FIG. 1 of a prior art garment, as manufactured inside out.
Figure 6:
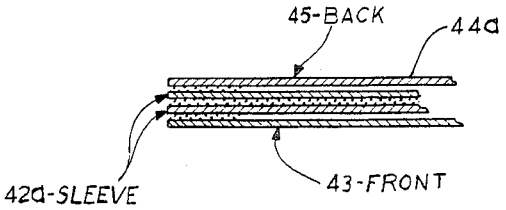
FIG. 6 is a fragmentary sectional view taken in the plane of lines 6—6 in FIG. 5 showing the seams in the region of the sleeve.
Figure 8:
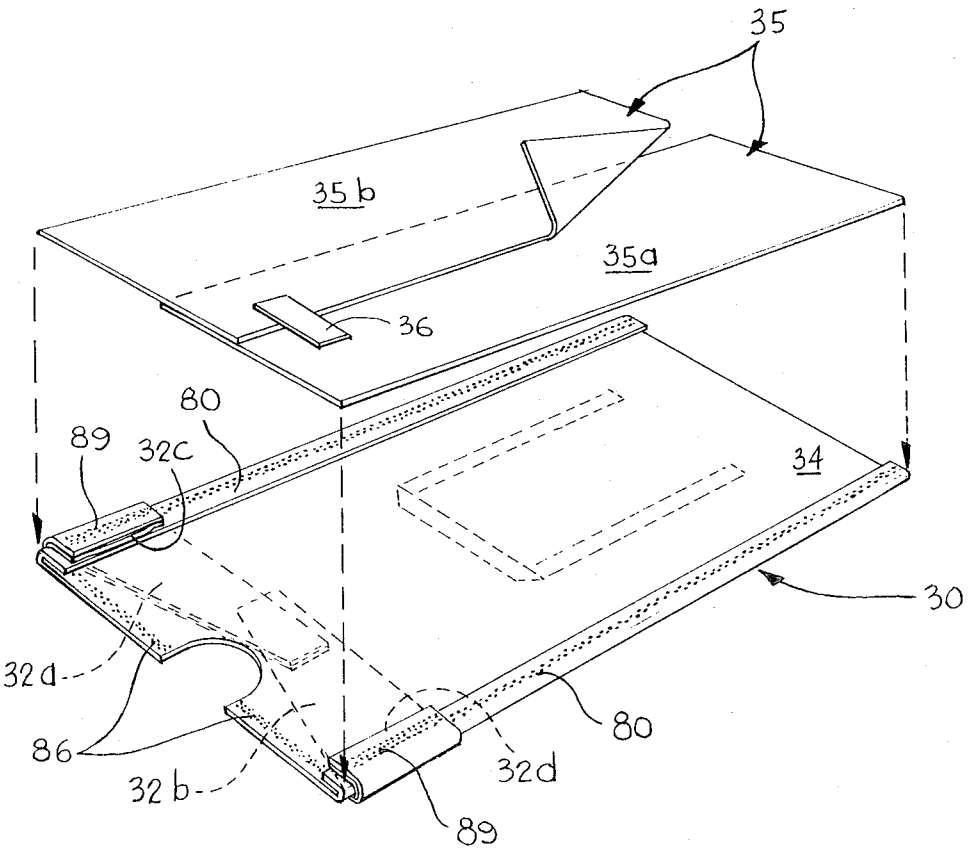
FIG. 8 is an exploded view of a garment as manufactured according to this invention.

Referring to FIG. 5, this type of prior art garment 40 may be manufactured from webs of textile-like material of various kinds, for example nonwoven webs of continuous polymeric filaments of the kind disclosed in U.S. Pat. No. 3,855,046. When manufactured on an automated production line, as illustrated in FIGS. 16–21, the garment 40 comes from the line in an inside out condition with, as shown in FIG. 5, the sleeves 42*a*, 42*b* lying between the front section 43 and the pair of panels 44*a*, 44*b* forming the back section 45 of the garment. To don a garment in this condition, it is necessary to unfold the back panels 44*a*, 44*b* around to the other side of the front section 43. At the same time the sleeves 42*a*, 42*b* are unfolded so that they extend outwardly, making the armholes 42*c*, 42*d* accessible from inside the garment rather than outside where they are shown in FIGS. 5 and 6. It is one of the advantages of the present invention that the garment 30 (FIG. 1) comes from the line in an outside out condition and may be put on without the necessity of reversing the garment. Thus, the garment 30 of this invention is ready to be put on merely by extending the sleeves 32*a*, 32*b* to the positions shown in FIG. 1. As manufactured, the sleeves 32*a*, 32*b* lie adjacent the front section 34, as illustrated in FIGS. 4 and 8.

Figure 7:
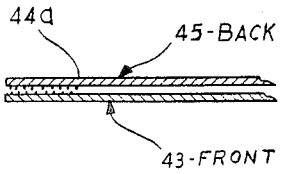
FIG. 7 is a fragmentary sectional view in the plane of lines 7—7 in FIG. 5 showing the side seam in a region apart from the sleeve.
Figures 16, 17, 18, 19, 20, 21:
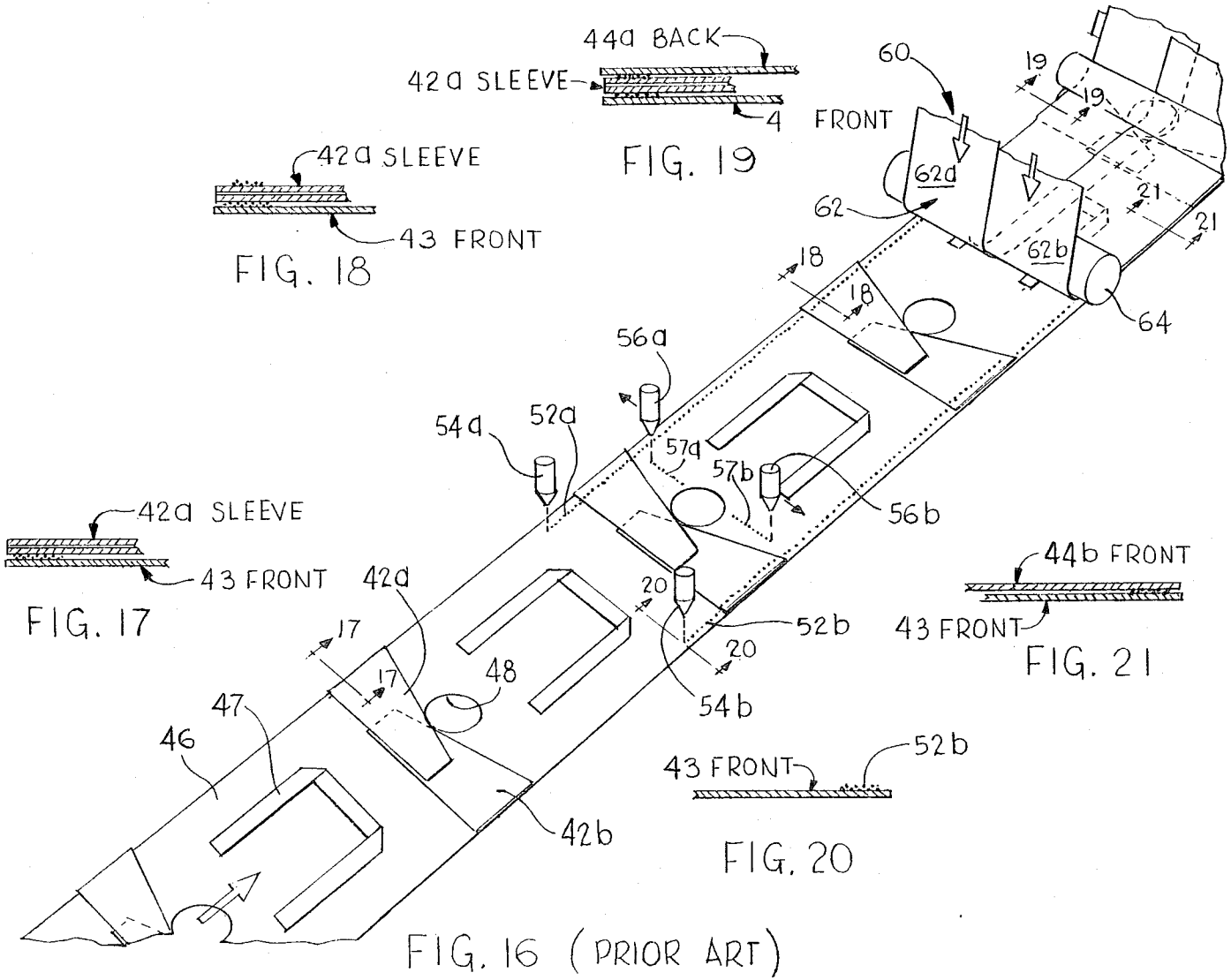
FIG. 16 (PRIOR ART)
FIG. 16 is a perspective view similar to FIG. 9 schematically illustrating a prior art garment production line for manufacturing garments of the kind shown in FIG. 5.
FIGS. 17–21 are fragmentary sectional views respectively taken in the plane of lines 17—17 to 21—21 in FIG. 16.

Briefly reviewing a prior art automated production line and method for manufacturing the garment 40 of FIGS. 5–7, in a very schematic manner and for purposes of illustration and explanation, FIG. 16 shows a continuous moving web 46 having pairs of premanufactured sleeves 42*a*, 42*b* which have been transferred to the moving web 46 of garment fabric in timed sequence with the high speed movement of the web and adhesively adhered to the web at spaced locations. This web 46 forms the front section 43 of the garment 40 which may be tied in the back by means of a belt 47. In like manner to the placement of the sleeves 42*a*, 42*b* on the web 46, the belts 47 have been placed on and adhered to the continuously moving web 46 of garment fabric. In addition, neck openings 48 have been cut in the moving web 46 of garment fabric at regular intervals along the length thereof. For convenience in description, the sleeve and belt placement and adhesive applying apparatus has not been detailed in FIG. 16 and lies upstream of the section shown in this Figure, the web 46 with the sleeves 42*a*, 42*b* and belts 47 adhered thereto coming from the bottom left hand corner of FIG. 16 and proceeding upward and to the right in this Figure. Longitudinal ribbons 52*a*, 52*b* of adhesive are applied to the lateral edges of the web 46 by a pair of adhesive applicators 54*a*, 54*b*; these adhesive ribbons 52*a*, 52*b* are applied also to the upwardly facing surfaces of the sleeves 42*a*, 42*b* and are provided for the purpose of bonding the panels 44*a*, 44*b* of the back section 45 of the garment 40 to the top surface of the web 46 and to the sleeves to form the side seams of the garment. Immediately following the application of adhesive ribbons 52*a*, 52*b* to the lateral edges of the web 46, the web 46 passes a pair of adhesive applicators 56*a*, 56*b* for applying ribbons 57*a*, 57*b* of adhesive extending transversely outwardly from the neck openings 48 to provide shoulder seams between the continuous web 46 forming the front section 43 of the garment 40 and the back panels 44*a*, 44*b* forming the back section 45 of the garment 40. Traversing nozzles are used for applying the shoulder seam adhesive or equivalent means may be used, such as a printing roll. Following the application of the shoulder seam adhesive and the side seam adhesive at the adhesive applying stations, the continuous web 46 is conveyed to a combining section 60 to which is brought a pair of overlapping, substantially half-width webs 62*a*, 62*b* which form the back panels 44*a*, 44*b* of the garment 40. After passing under a roll 64, the webs 62*a*, 62*b* are bonded to the sleeves 42*a*, 42*b* and to the web 46 along the edges thereof as well as transversely at spaced intervals by the ribbons of adhesive which were previously applied to provide the side and shoulder seams. The lengthwise continuous webs 46, 62*a*, 62*b* with sleeves 42*a*, 42*b* lying between the webs are subsequently cut transversely at regular intervals immediately adjacent the shoulder seams and through the neck openings to provide finished garments which, in effect, are manufactured inside out.

Referring again to FIGS. 1–4, a garment 30 constructed according to this invention is shown as having front and back sections 34, 35 of fabric. Formed from continuous, uniform width webs 70, 72 (FIG. 9), the front and back sections 34, 35 are perfectly rectangular, although these sections could be fashioned into a tapered shape by additional cutting operations and by changing the arrangement of the seams to match the shapes of the body sections of the garment. In such case, the garment 30 would retain its substantially rectangular configuration although shaped for aesthetic or additional functionality.

This garment 30 has square shoulders, provided by shoulder seams 74 joining one end of the sections 34, 35 and extending transversely from a neck opening 76 in the front section 34, which could also extend to the back section 35 if desired. A belt 75 is attached to the front section 34.

Similar to prior art garments, the front and back sections 34, 35 of the garment and the sleeves 32*a*, 32*b* are attached along seams which may be formed by adhesive or by other bonding methods, such as ultrasonic bonding where heat bondable materials are used, and sewing. For purposes of disclosing the preferred mode of seam forming as herein shown, adhesive is applied in the form of lines, strips or ribbons to the webs as they pass through stations of the automated production line. Various types of adhesive may be used, such as latexes, but hot melt adhesives may also be used and, for many types of fabrics including the continuous filament webs mentioned above, are preferred.

In addition to the shoulder seams 74, longitudinal side seams 78 are provided which join inwardly folded edge portions 80 of the full width front section 34 at both side edges to flat portions 82 at the side edges of the back section 35, which is divided longitudinally into panels 35*a*, 35*b* which overlap and have a closure 36, such as an adhesive tab. With this arrangement of adhesively joined folded portions 80 and flat portions 82 at the edges of the garment sections, which is preferred in this garment, a lapped side seam 78, which has a finished appearance (see FIG. 3), is provided that is subjected to shear rather than peel stresses when the garment 30 is being worn. The pair of sleeves 32*a*, 32*b* is also joined between the front and back sections 34, 35 of the garment 30 at the arm holes 32*c*, 32*d* thereof. Such sleeves 32*a*, 32*b* are tubular and may be manufactured by adhesively or otherwise attaching shaped pieces of material, herein shown as pieces of fabric adhesively joined along the top and bottom edges to provide flattened tubular sleeves. These sleeves 32*a*, 32*b* are joined to both the front and back sections 34, 35 of the garment at the arm hole ends 32*c*, 32*d* thereof by seams. To this end, the sleeves 32*a*, 32*b* are positioned between inwardly folded portions 80, herein shown on the front section 34, and flat portions 82, herein shown on the back section 35, and adhesive lines form the seams joining both front and back sections to the facing surfaces of the arm hole portions of each sleeve.

As seen in FIG. 8, the garment sections 34, 35 and sleeves 32*a*, 32*b* are assembled such that the arm holes 32*c*, 32*d* of the sleeves are accessible from inside the garment 30 to permit a wearer to don the garment without first reversing it, as is necessary with many prior art manufactured garments.

Figures 9, 10, 11, 12, 13, 14:
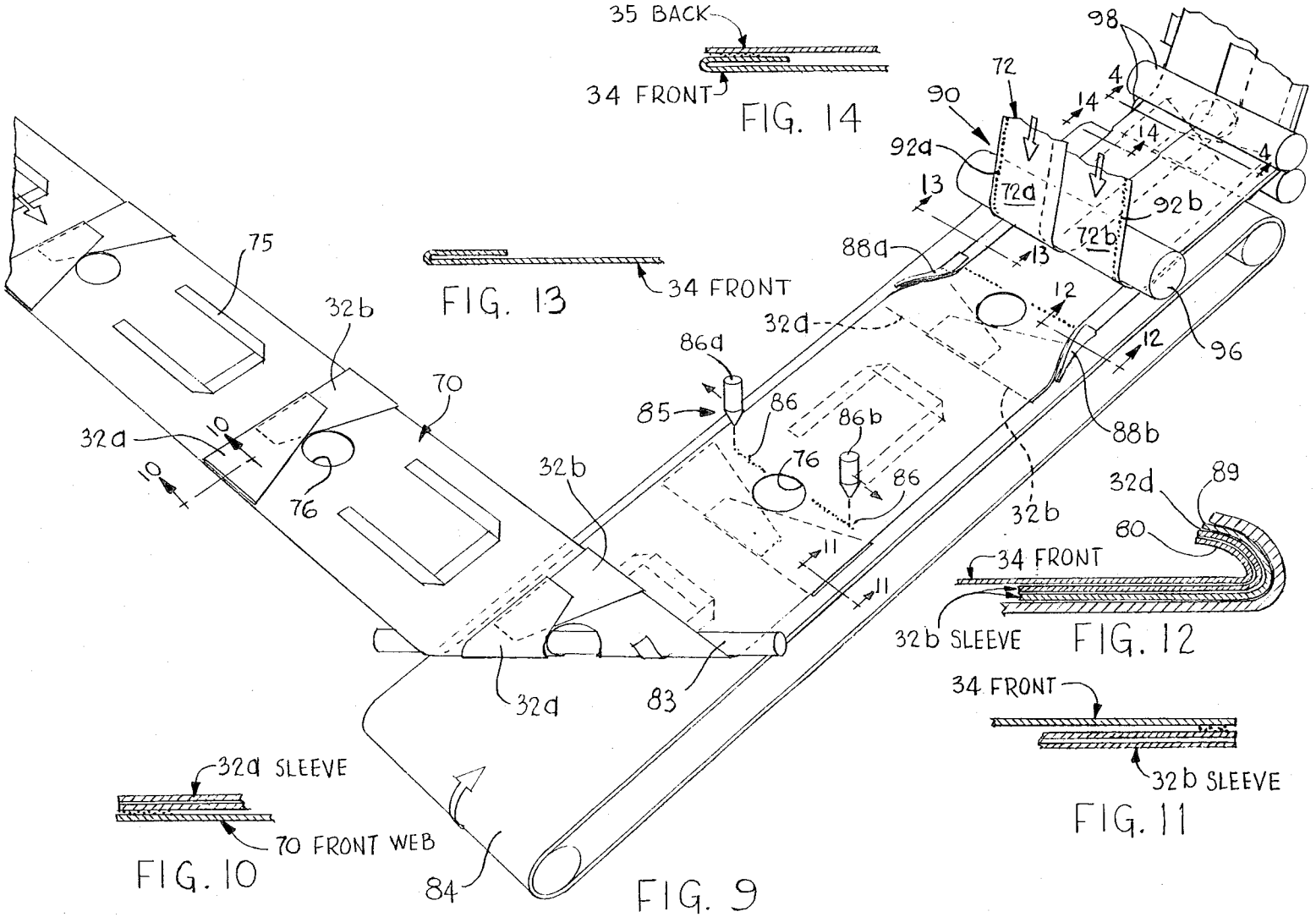
FIG. 9 is a perspective view schematically illustrating an automated production line for carrying out a preferred method for manufacturing garments according to this invention.
FIGS. 10–14 are fragmentary sectional views respectively taken in the planes of lines 10—10 to 14—14 in FIG. 9.

Turning again to FIGS. 9–15, in accordance with this invention a sleeved garment 30 (FIG. 1) is produced in an outside out condition from continuous webs. Pairs of flattened, tubular sleeves 32*a*, 32*b* have been attached to a continuous moving web 70 of garment fabric. Since the sleeves 32*a*, 32*b* may be transferred to and attached to the moving web 70 in any desired manner, the upstream section of the production line where these operation are performed is not detailed nor is that section shown where belts 75 have been attached to the web 70 and neck openings 76 cut at regular intervals. The web 70 provided with the sleeves 32*a*, 32*b* and belt 75 on the upper surface of the web 70 is shown in FIG. 9 moving in the direction from the upper left hand corner diagonally toward the right. In keeping with this invention, the web 70 passes around a turning bar 83 and into contact with the upper surface of a belt conveyor 84 moving substantially at right angles to the original direction of the moving web 70. By passing around the turning bar 83, the sleeves 32*a*, 32*b* and belt 75, which previously were on the upper surface of the web 70, are transferred to the under surface of the web 70 with the conveyor 84 supporting the belts and sleeves and holding them flat against the under surface of the moving web 70. It will be noted that the right sleeve 32*a* of each pair (viewed in the direction of movement of the web 70) overlaps the other sleeve 32*b* so that in moving around the turning bar 83, the end of the trailing sleeve 32*b* is tucked under the leading sleeve 32*a* to assist in moving under the bar 83 without disruption.

After moving past the turning bar 83, the web 70 is carried to an adhesive application station 85 where transverse strips or ribbons of adhesive 86 are applied adjacent to the neck openings 76 by traveling or traversing nozzles 86*a*, 86*b* (or a print roll). These adhesive strips or ribbons 86 are applied in such a way as to extend to the margins of the moving web 70 and will form the shoulder seams 74 in the finished garment 30. As previously indicated, while adhesive is preferred for forming the garment seams, other attachment methods may be used.

Following the shoulder seam adhesive application station 85, the moving web 70 is carried to curved folding bars 88*a*, 88*b* positioned adjacent to the edges of the moving web 70 to fold lateral edge portions 80 of the continuous web 70 inwardly on itself to provide a continuous edge fold. The edge folding operation is also effective to fold a strip of the sleeves (see FIG. 12) at the arm hole ends 32*c*, 32*d* of the sleeves where they are joined to the edge portions 80 of the continuous web 70. The folding operation on one edge of the web 70 is illustrated in FIG. 12. This edge folding operation folds a narrow strip of both sleeves 32*a*, 32*b* from underneath the continuous web 70 to the top of such web 70 so that a narrow strip 89 (FIG. 12) of one layer of sleeve material is presented on the top surface of the assembly moving along the conveyor 84 and is longitudinally contiguous with the inwardly folded edge portion 80 of the continuous web 70.

Figure 15:
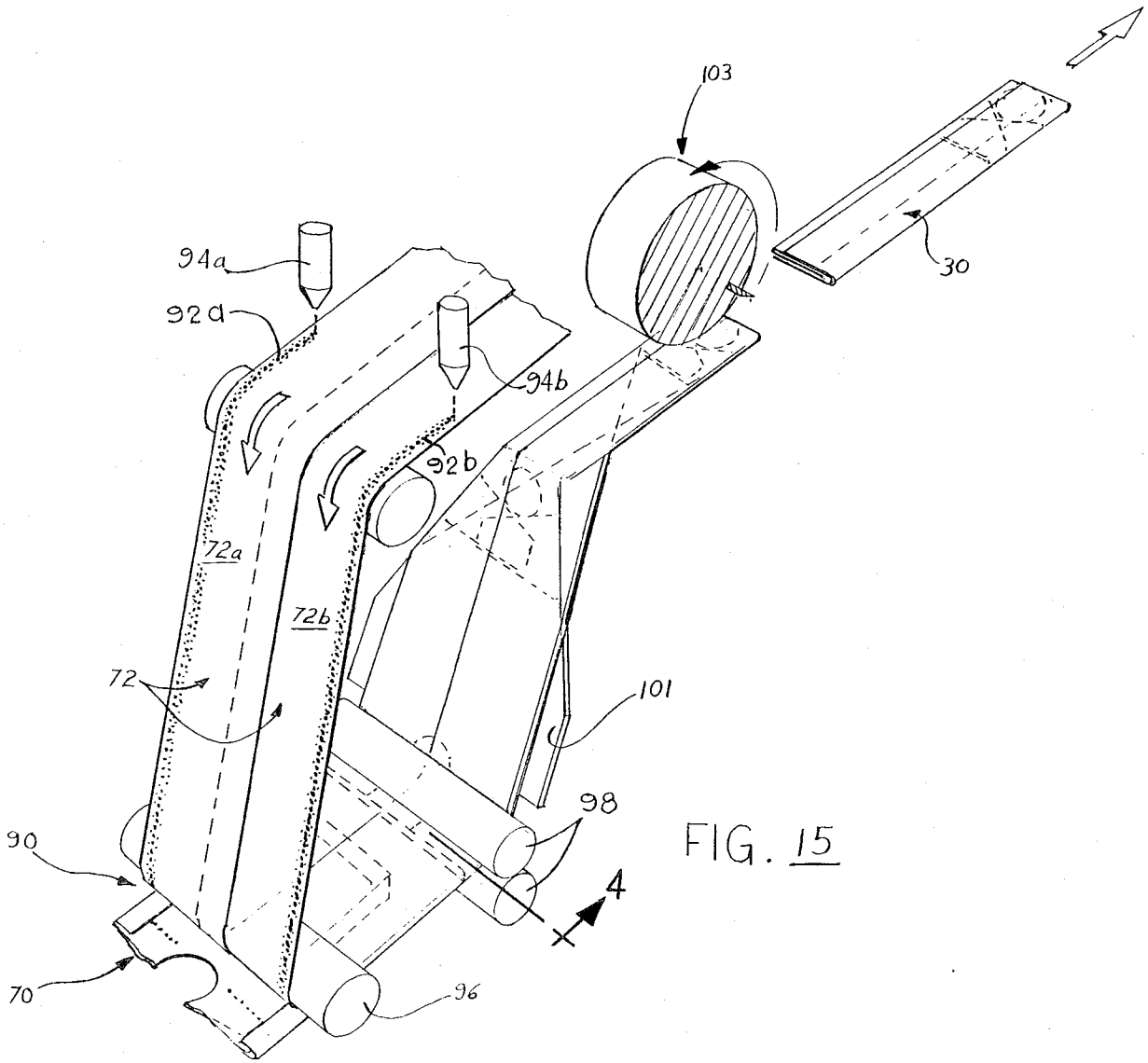
FIG. 15 is a perspective view of the folding and cut-off sections of the automated production line of FIG. 9.

After the edge folding operation, the continuous web 70 and garment components (sleeves and belts) attached thereto are conveyed to a combining section 90 where a second web 72, longitudinally divided, in this case, into two overlapping substantially equal-width webs 72*a*, 72*b* which are adapted to form the complementary back panels 35*a*, 35*b* of the finished garment 30, are adhered to the continuous web 70. Referring also to FIG. 15, which shows the combining section 90 and the downstream folding and cutting sections, it will be seen that partial-width webs 72*a*, 72*b* from supply rolls or the like and forming the second web 72 are carried downward in this Figure toward the combining section 90. Longitudinal ribbons or strips of adhesive 92*a*, 92*b* are applied to the longitudinal lateral edges of the second web 72 by a pair of adhesive dispensers 94*a* and 94*b* and the web 72 is then carried around a roll 96 in the lower portion of FIG. 15, which is part of the combining section and serves to press the two partial-width webs 72*a*, 72*b* against the exposed upper surface of the continuous web 70 and the infolded lateral edge portions 80 of the web 70 and the narrow strips 89 of both sleeves. The previously applied adhesive ribbons along the edges of the web 70 and extending transversely are effective to attach the webs 70, 72 and the sleeves 32*a*, 32*b* and form the side and shoulder seams. After being combined, the webs 70, 72 and sleeves 32*a*, 32*b* are carried through the nip rolls 98, the distance and time of travel in the combining section 90 being selected to insure that the adhesive on the various webs of material is effective to bond the webs and sleeves together.

After passing through the nip rolls 98, the webs 70, 72 and attached sleeves and belts are folded to reduce the overall width for packaging and are then cut to provide the finished garments. The webs 70, 72 are carried to a folding board 101 which performs the operation of folding the webs inwardly from both sides and, following the folding board 101, the folded webs are conveyed to a cut-off knife 103 which operates to cut the webs transversely at regular intervals through the neck opening 76 and adjacent the shoulder seams 74 to provide garments. Such individual garments 30 are then carried to a packaging station downstream.

Figure 1:
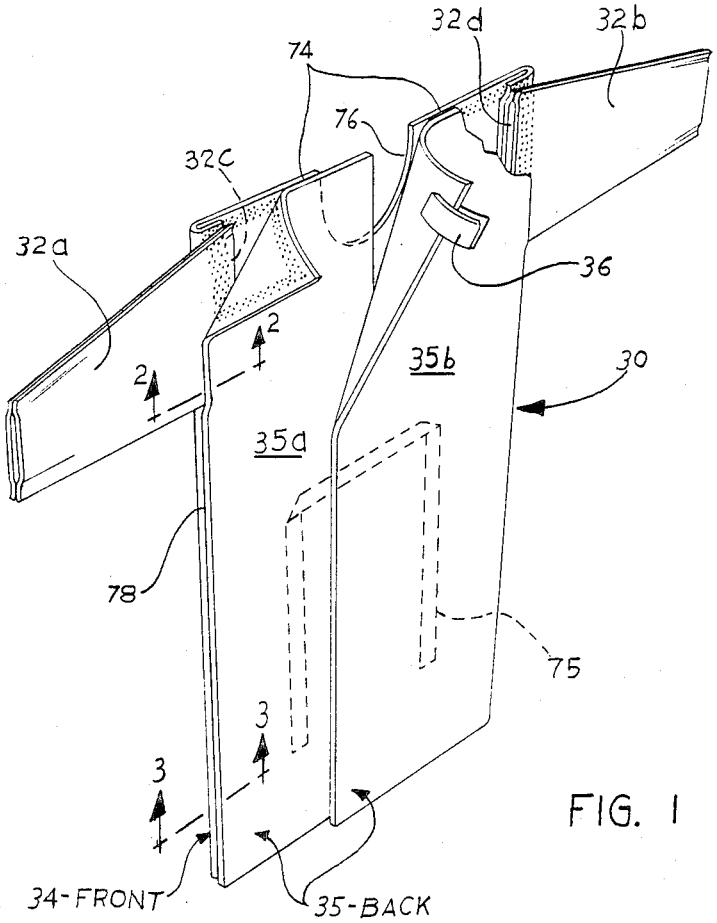
FIG. 1 is a perspective view of a preferred form of garment manufactured according to this invention with the sleeves of the garment extended and certain portions of the garment folded or broken away to reveal the seam construction.
Figure 2:
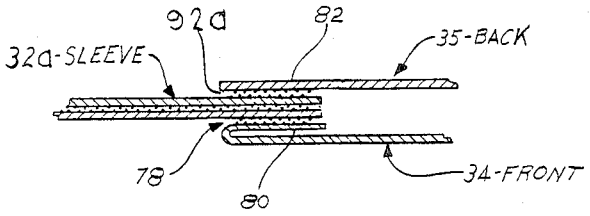
FIG. 2 is a fragmentary sectional view taken in the plane of lines 2—2 in FIG. 1 showing the seams in the region of the lower edge of the sleeve.
Figure 3:
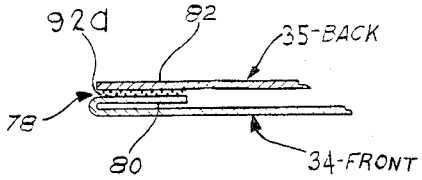
FIG. 3 is a fragmentary sectional view taken in the plane of lines 3—3 in FIG. 1 showing the side seam.

Referring to FIG. 4, this sectional view is taken of the lengthwise continuous webs 70, 72 and the sleeves 32*a*, 32*b* in the combining section 90 of the automated line shown in FIG. 9. The sleeves 32*a*, 32*b* are inwardly folded and lie under the webs 70, 72 which form the front and back sections of the finished garment and are illustrated in the position reached before further folding operations for packaging. When removed from a package, the reverse of the folding operation carried out by the folding board 101 is first required before the garment can be put on. The garment will then be in the arrangement shown in FIG. 4 with the arms 32*a*, 32*b* folded against the front section 34 of the garment. Merely by unfolding the sleeves 32*a*, 32*b* so as to extend them, as shown in FIGS. 1 and 2, but without the necessity of reversing the garment, the garment 30 is ready to be put on.

I claim:

1. A method for the series manufacture of garments outside out comprising the steps of:

providing a moving, lengthwise continuous first fabric web having, at successive intervals, sets of left and right pairs of flattened tubular sleeves extending transversely inwardly from the lateral edges of said first web, said sleeves having one layer of each flattened sleeve attached at the arm hole portion to one surface of said web;

folding lateral edge portions of said moving first web inwardly on itself, including a strip of the arm hole end of each sleeve adhered thereto, on the other surface of said first web to provide inwardly folded edge portions of said first web and longitudinally contiguous strips of said sleeves adjacent the lateral edges of said first web;

attaching said inwardly folded portions of said moving first web and said longitudinally contiguous strips of said sleeve to a moving lengthwise continuous second fabric web to provide side seams joining said webs and said sleeves;

attaching said first and second webs along transverse lines adjacent said sets of sleeves to provide shoulder seams at successive intervals; and cutting said moving continuous webs transversely successively adjacent said shoulder seams to provide finished garments.

2. A method according to claim 1 wherein said second web is longitudinally divided into partial-width webs.

3. A method according to claim 1 including providing neck openings along the median line of said moving first web at successive intervals and adjacent said sets of sleeves, and attaching said webs along transverse lines providing shoulder seams extending from said neck openings.

4. A method according to claims 1, 2 or 3 wherein said moving first web is provided with said sleeves on the upper surface of said web and including the steps of:

turning said moving first web to carry said sleeves to the under surface thereof;

folding lateral edge portions of said moving first web, including a strip of each sleeve, inwardly on the upper surface of said first web; and combining a moving second web onto the upper surface of said moving first web and bringing the edges of said second web into contact with the upper surface of inwardly folded portions of said first web and strips of said sleeves.

5. In a method for the series manufacture of garments from moving continuous webs, including a first fabric web having, at successive intervals, sets of left and right pairs of flattened tubular sleeves attached at shoulder ends to lateral edges of said first web so as to extend transversely inwardly and a second fabric web attached to said sleeves and said lateral edges of said first web, the improvement comprising:

folding portions of the lateral edges of one of said moving webs inwardly before attaching said inwardly folded portions to lateral edges of the other web to provide lapped side seams joining said webs and said sleeves.

* * * * *